US008196438B2

(12) United States Patent
Traenkle et al.

(10) Patent No.: US 8,196,438 B2
(45) Date of Patent: Jun. 12, 2012

(54) METHOD AND KNITTING MACHINE FOR THE PRODUCTION OF KNITTED GOODS WITH HORIZONTAL STRIPE PATTERNS

(75) Inventors: Dietmar Traenkle, Balingen (DE); Uwe Sauter, Albstadt (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 12/873,645

(22) Filed: Sep. 1, 2010

(65) Prior Publication Data

US 2011/0056247 A1 Mar. 10, 2011

(30) Foreign Application Priority Data

Sep. 8, 2009 (DE) ..... 10 2009 040 739

(51) Int. Cl.
*D04B 15/60* (2006.01)

(52) U.S. Cl. ..... 66/138

(58) Field of Classification Search ..... 66/138, 66/139, 140 R, 146, 134
See application file for complete search history.

(56) References Cited

U.S. PATENT DOCUMENTS

| | | | | |
|---|---|---|---|---|
| 3,788,104 | A * | 1/1974 | Billi | 66/138 |
| 4,385,507 | A | 5/1983 | Sawazaki | |
| 4,656,842 | A * | 4/1987 | Sawazaki et al. | 66/139 |
| 5,070,709 | A * | 12/1991 | Guell | 66/140 R |
| 5,826,446 | A * | 10/1998 | Plath et al. | 66/140 R |
| 6,000,245 | A | 12/1999 | Plath et al. | |
| 7,073,355 | B2 * | 7/2006 | Traenkle et al. | 66/138 |
| 7,845,196 | B1 * | 12/2010 | Pai | 66/133 |
| 2006/0010928 | A1 * | 1/2006 | Traenkle et al. | 66/133 |
| 2011/0056247 | A1 * | 3/2011 | Traenkle et al. | 66/139 |

FOREIGN PATENT DOCUMENTS

| | | | |
|---|---|---|---|
| DE | 356832 | | 8/1922 |
| DE | 2 111 212 | | 10/1971 |
| DE | 26 11 036 | | 12/1976 |
| DE | 27 10 045 | | 9/1977 |
| DE | 28 05 779 | | 8/1978 |
| DE | 31 29 724 | | 4/1982 |
| DE | 195 11 949 | | 10/1996 |
| DE | 19511949 | A1 * | 10/1996 |
| DE | 10 2004 033 655 | | 2/2005 |
| EP | 1 612 311 | | 1/2006 |
| EP | 2 161 359 | | 3/2010 |
| GB | 1 335 494 | | 10/1973 |
| GB | 1 520 174 | | 8/1978 |
| WO | 2008/139713 | | 11/2008 |

* cited by examiner

*Primary Examiner* — Danny Worrell
(74) *Attorney, Agent, or Firm* — Michael J. Striker

(57) ABSTRACT

In a method and a knitting machine for the production of knitting goods with horizontal stripe a comparatively wide thread changing device having a plurality of thread fingers can be associated with two knitting points in such a manner that a first portion of the threads guided by the thread changing device can be fed to one knitting point and another portion of the threads can be fed to the other knitting point or to the knitting tools respectively moved there into a thread pick-up position.

8 Claims, 9 Drawing Sheets

METHOD AND KNITTING MACHINE FOR THE PRODUCTION OF KNITTED GOODS WITH HORIZONTAL STRIPE PATTERNS

CROSS-REFERENCE TO RELATED APPLICATION

The invention described and claimed hereinbelow is also described in German Patent Application DE 10 2009 040 739.1 filed on Sep. 8, 2009. This German Patent Application, whose subject matter is incorporated here by reference, provides the basis for a claim of priority of invention under 35 U.S.C. 119(a)-(d).

BACKGROUND OF THE INVENTION

The present invention relates to a method and a knitting machine for production of knitted goods with horizontal stripe patterns.

Most known knitting machines for the production of knitted goods with horizontal stripe patterns, in particular large circular knitting machines, have striping attachments having thread changing devices provided with a specific number, e.g. four, thread fingers, so that on each knitting system formed from a knitting point and a thread changing device one or more of four different, in particular differently coloured, threads can be selectively inserted into the knitting tools (e.g. DE 27 10 045 A1, DE 28 05 779 A1, DE 31 29 724 C2, DE 195 11 949 A1).

However, there is frequently a requirement for knitted goods with horizontal stripe patterns that can be produced from five or more different threads per system. To produce such horizontal stripe patterns, thread changing devices that have five or more thread fingers, for example, can be provided. However, as a result of this there is a corresponding increase in the width of the thread changing devices measured in the knitting direction, and therefore either the number of knitting systems that can be attached to the periphery of a circular knitting machine, for example, must be reduced or, if a large number of feeder systems is still desired, a thread changing device cannot be assigned to all the knitting systems present. While it would be conceivable to configure the thread fingers and associated parts to be thinner than usual, this is not possible to a sufficient degree on structural grounds and would, moreover, be associated with increased wear and lower operating reliability.

Therefore, circular knitting machines have already become known (EP 1 612 311 B1) that have striping attachments with two or more thread changing devices arranged directly one after the other in the knitting direction such that threads delivered by one and/or the other thread changing device can be selectively processed on the very same knitting system. An advantage of this arrangement is that a thread changing device with only a few thread fingers can be attached to each individual knitting system. However, there also results here the undesirable effect that when using large circular knitting machines with a high number of systems the width of a thread changing device is larger than the width of the system, even if each thread changing device can only deliver three or four threads.

SUMMARY OF THE INVENTION

Working from this prior art, the technical problem of the present invention lies in remedying this and providing a striping attachment with a thread changing device that can be used more flexibly then previously and substantially meets existing requirements in the production of horizontal stripe patterns.

In keeping with these objects and with others which have become apparent hereinafter, one feature of the present invention resides, briefly stated, in a method for production of knitted goods with horizontal stripe patterns on a knitting machine containing knitting tools, at least one first knitting point, a second knitting point arranged in front of the first knitting point in a knitting direction, and also at least one thread changing device, the method comprising the steps of bringing at least some of the knitting tools at the first knitting point into a thread pick-up position; by the thread changing device, fitting at least one selected thread to the knitting tools brought into the thread pick-up position at the first knitting point; associating the thread changing device with the first and the second knitting points; and selectively feeding by the thread changing device at one selected thread in each case to the knitting tools brought into the thread pick-up position at a knitting point selected from the group consisting of at the first knitting point, at the second knitting point, and at both knitting points.

Another feature of the present invention resides in a knitting machine for production of knitted goods with horizontal stripe patterns, comprising at least one support provided with movable knitting tools; a cam with at least one first knitting point and a second knitting point arranged in front in a knitting direction for moving selected knitting tools into a thread pick-up position; and at least one thread changing device for feeding selected threads to the knitting tools brought into the thread pick-up position at the first knitting point, wherein the thread changing device is configured and arranged in such a manner that the threads which are fed with it are selectively fed to the knitting tools moved into a thread pick-up position at a knitting point selected from the group consisting of the first knitting point, the second knitting point, and both.

The invention is based on the idea of assigning a single thread changing device to two or more knitting points instead of the reverse hitherto of assigning two or more thread changing devices to a single knitting point. Consequently, the threads that can be fed with a single thread changing device are distributed over knitting tools that are brought into a thread pick-up position at least two adjacent knitting points. As a result of this, it is possible, for example, to control a thread changing device provided with six thread fingers, as desired, so that three thread fingers supply the knitting tools at a first knitting point and the remaining three thread fingers supply the knitting tools at a second knitting point with different threads.

The advantages of this measure are that, on the one hand, thread changing devices can be used that have more than four thread fingers, for example, and therefore have a substantially larger width than one knitting system, whereas on the other hand in the case where not all the threads of one thread changing device are needed for horizontal striping, two adjacent knitting points can be supplied with threads by the same thread changing device and can be used for horizontal striping with a correspondingly reduced number of threads, as a result of which production is simultaneously increased accordingly. Moreover, the advantage is used that the width of a thread changing device for six threads, for example, is smaller than the total width of two thread changing devices for three threads each. As a result, the system width can be reduced and the number of systems can be increased.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
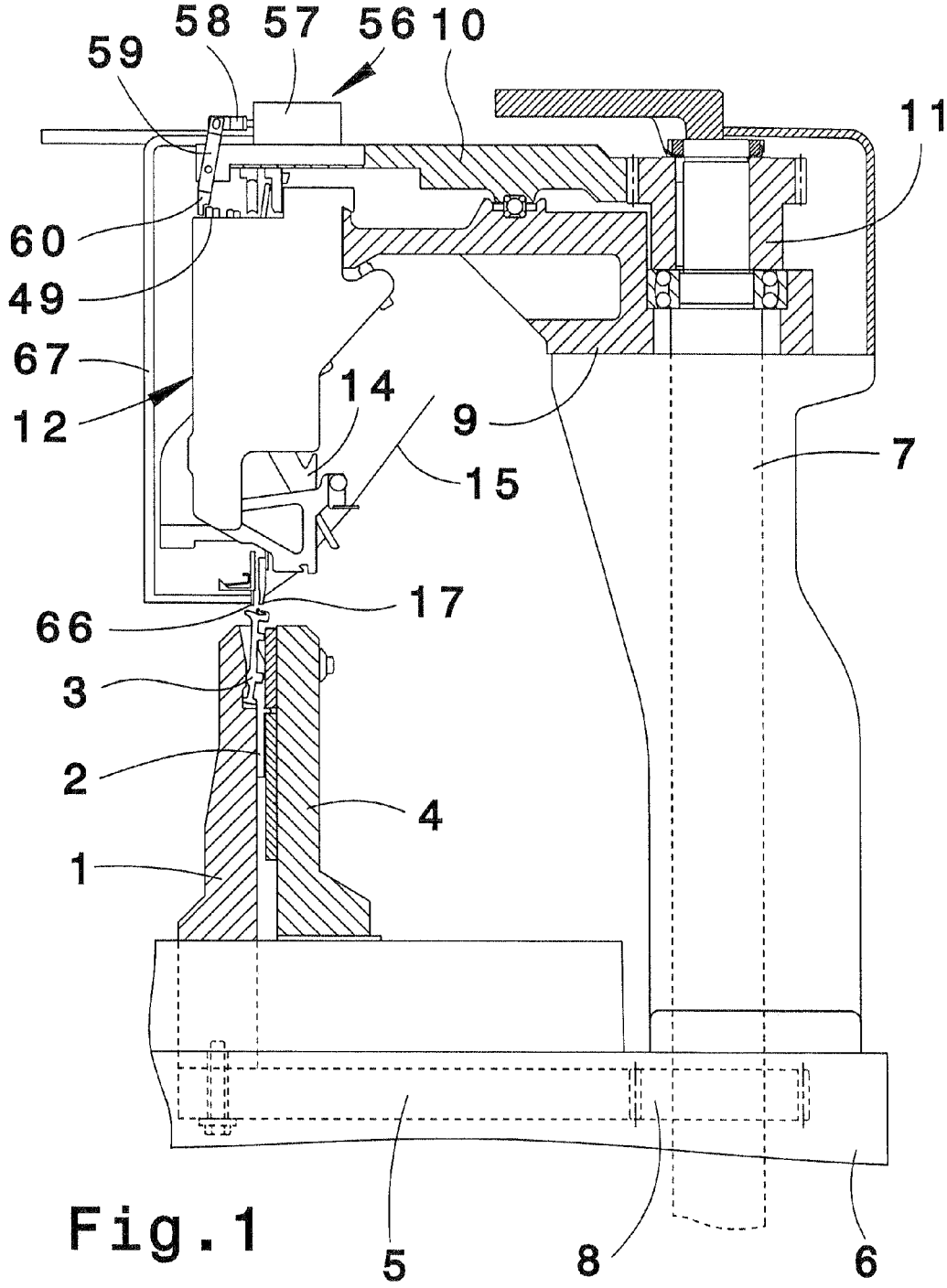
FIG. 1 is a side view in partial section of a circular knitting machine according to the invention.

The invention is explained in more detail below on the basis of a circular knitting machine and an exemplary embodiment currently considered to be the best.

For this purpose, as FIGS. 1 to 4 show, the circular knitting machine includes a support 1 in the form of a needle cylinder, which is mounted to be rotatable around a vertical rotational axis and is provided with knitting tools in the form of latch needles 2 and sinkers 3, which are arranged to be both radially displaceable and axially movable up and down. The movements of the knitting tools 2, 3 are controlled with cam parts in a known manner, which are fastened to a cam box ring 4 fixedly mounted in a machine frame. Moreover, the support 1 is supported on a support ring 5, which is rotatably mounted on a base plate 6 and can be set in rotation by means of a gear wheel 8 fastened to a drive shaft 7.

In a part of the frame located above the support 1, a ring-shaped holder 9 is fixedly mounted, on which a support ring 10 coaxial to the support 1 is rotatably mounted by means of bearings, and said support ring can be set in rotation synchronously to the support 1 by a gear wheel 11 that is likewise fastened to the drive shaft 7.

At least one, but preferably a plurality of thread changing devices 12 is fixedly mounted on the holder 9 and in the exemplary embodiment these preferably have six thread fingers 14, for example, which can each insert one thread 15 that is drawn off from a supply coil (not shown in more detail) into a thread guide 17, which feeds these threads to the hooks of the knitting tools 2.

Figure 2:
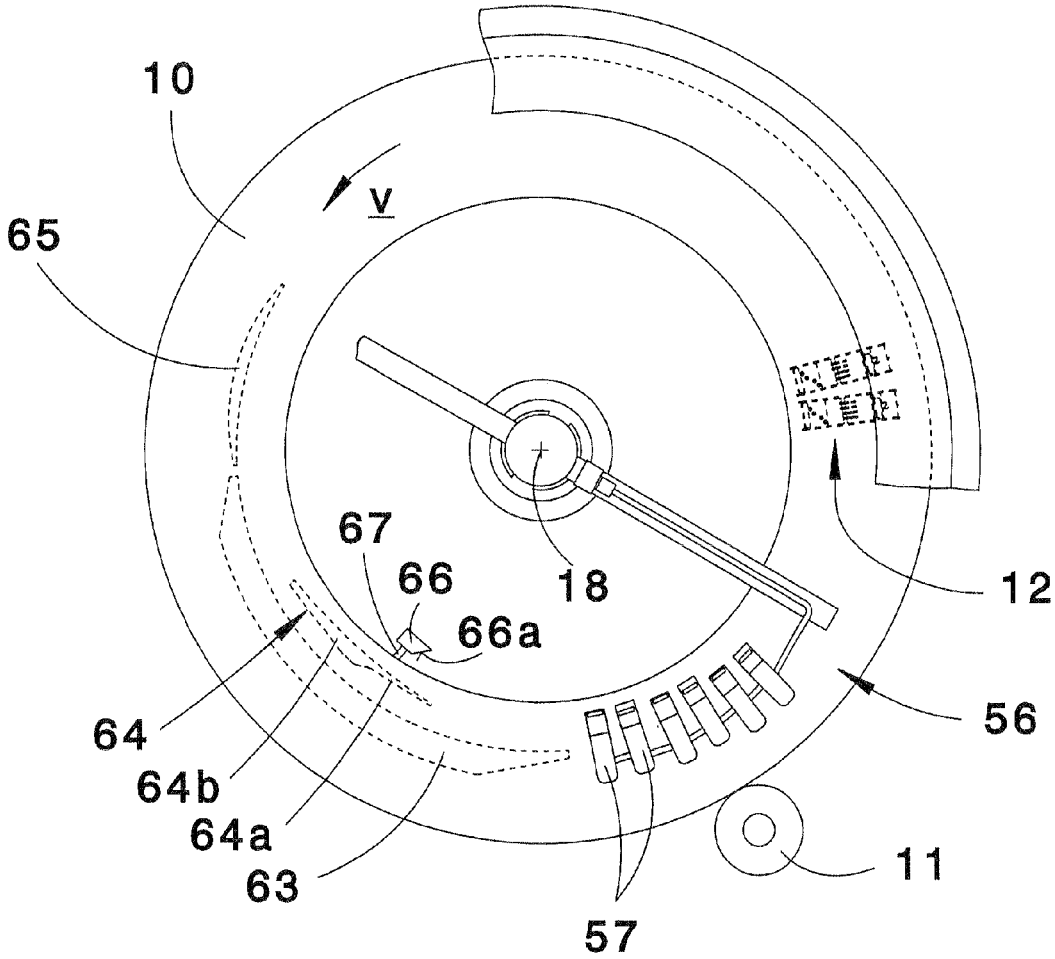
FIG. 2 is a schematic plan view onto parts of the circular knitting machine according to FIG. 1 required for the invention.

FIG. 2 schematically shows primarily the support ring 10 and the gear wheel 11, wherein a rotational axis for the support ring 10 and the support 1 (not visible) is indicated with the reference 18. Parts indicated in broken lines in FIG. 2 are arranged below the support ring 10 in accordance with FIG. 1. In this case, for the sake of simplicity, only two thread changing devices 12 are shown that are distributed around the rotational axis 18 at short distance from one another. With one respective knitting point, on which the knitting tools 2, 3 can be moved into thread pick-up positions in order to pick up the threads 15, the thread changing devices 12 normally form one knitting system in each case.

Figure 3:
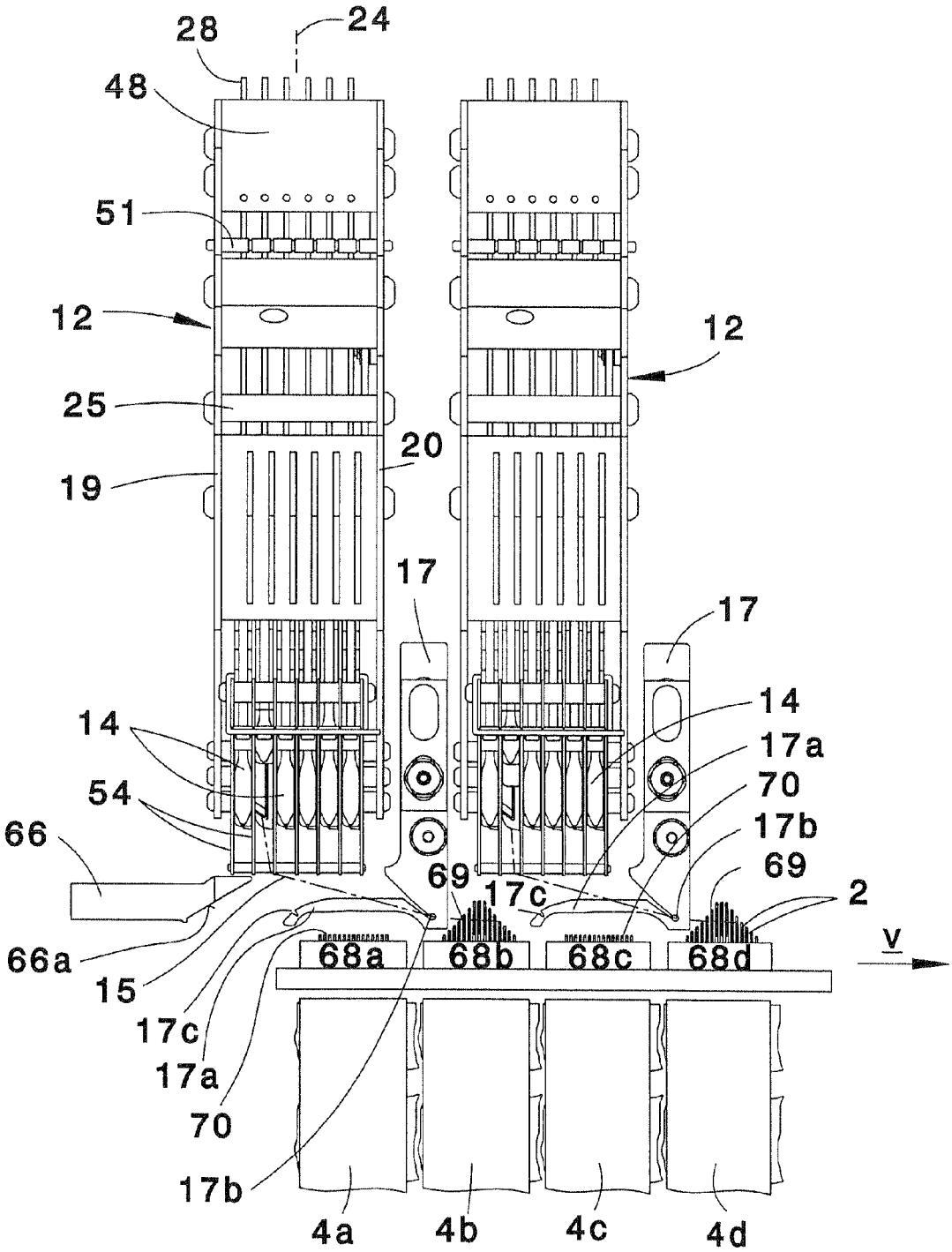
FIG. 3 is a front view of four adjacent knitting points and two thread changing devices assigned to these of the circular knitting machine according to FIG. 1.
Figure 4:
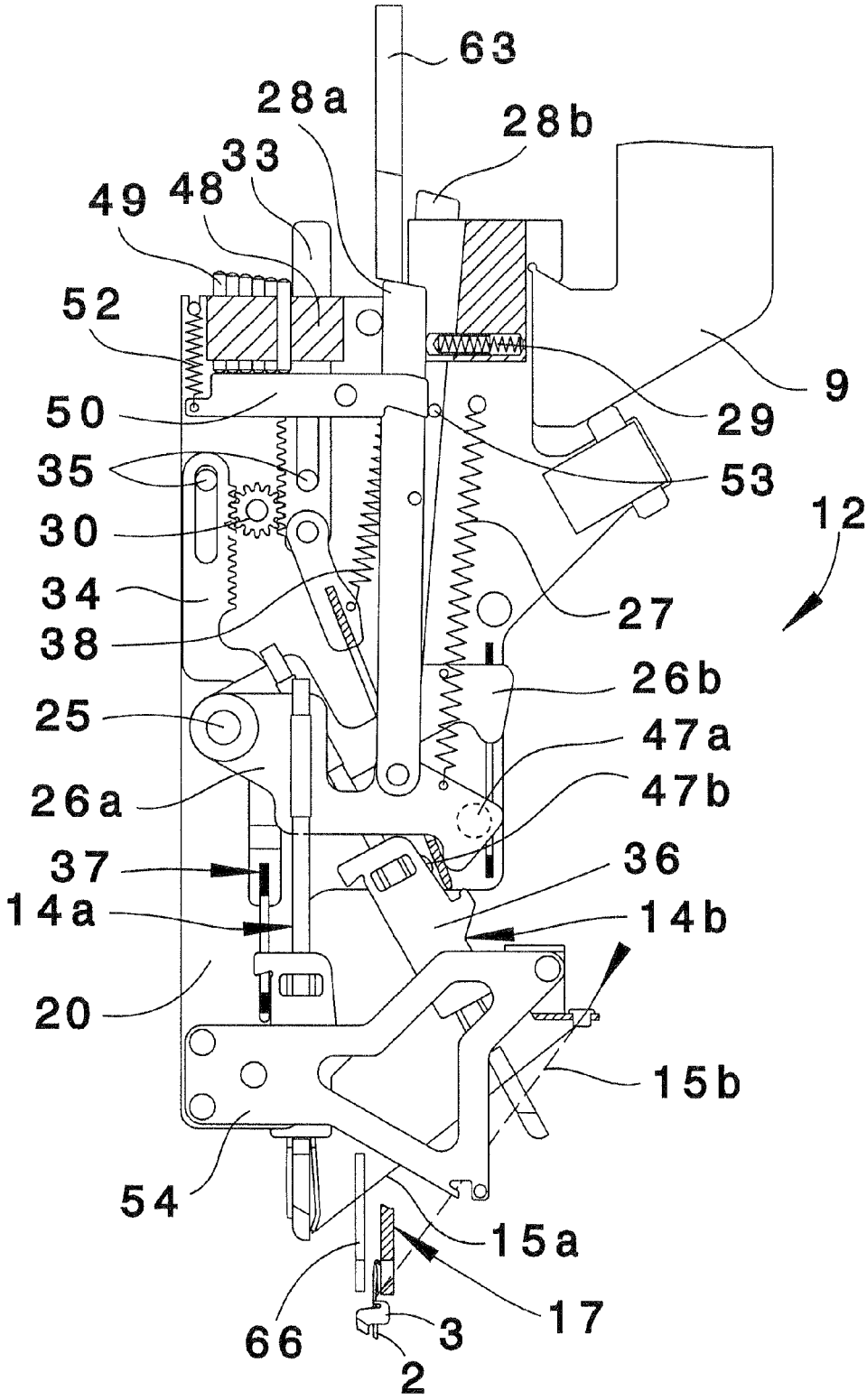
FIG. 4 is a side view of a thread changing device evident from FIG. 3.

According to FIGS. 3 and 4 each thread changing device 12 contains a housing formed substantially from two parallel side plates 19 and 20, wherein side plate 19 has been omitted in FIG. 4 in order to allow a free view into the interior of the housing. In an upper front portion the side plates 19 and 20 have attachments that serve to fasten the thread changing devices 12 to the holder 9. A longitudinal axis 24 (FIG. 3) of the housing is arranged vertically, i.e. parallel to the direction of displacement of the knitting tools 2 and preferably parallel to the rotational axis of the support 1.

A bolt 25 arranged between the side plates 19, 20 serves to mount plate-shaped, single-arm rocker levers 26*a* and 26*b* of thread fingers 14*a* and 14*b* to allow them to pivot. The rocker levers 26*a* and 26*b* are biased by a respective spring 27 into a base position evident from FIG. 4. Each rocker lever 26*a*, 26*b* is pivoted to a respective associated selector lever 28*a*, 28*b*, which is arranged substantially parallel to the longitudinal axis 24 and above the rocker levers 26*a*, 26*b* and with its upper end in a base position, in particular in a working position still to be explained, projects upwards out of the housing of the thread changing device 12. Each selector lever 28*a*, 28*b* stands under the bias of a spring 29, which endeavours to pivot it radially inwards transversely to the longitudinal direction and in relation to the circular knitting machine according to FIGS. 1 and 2.

A gear wheel 30 that engages with two parallel toothed rails is rotatably mounted on a further bolt. One toothed rail is attached to the edge on the left in FIG. 4 of a slide 33 and the other toothed rail is attached to the right edge of a slide 34. In a base position the upper end of slide 33 projects upwards out of the housing of the thread changing device 12. Both slides 33, 34 are movably guided with longitudinal holes on bolts 35. One end of a closer 36 is pivoted to the lower end of the slide 33, whereas slide 34 is preferably fixedly connected to an opener 37 at its lower end. The closer 36 is normally biased radially outwards against a stop 47*a* by a spring 38, but can be pivoted radially inwards in clockwise direction and against the force of the spring 38 until it abuts against a stop 47*b*. Moreover, in a base position the spring 38 holds the slide 33 in its uppermost position in FIG. 4, but holds slide 34 in its lowest position in FIG. 4. Parts 30 to 35 form a deflection gear serving to jointly actuate the closer 36 and opener 37. The closer 36 and the opener 37 advantageously extend over the entire width of the housing.

A guide body 48 (FIG. 4), in which six control pins 49 are guided with sliding fit parallel to the longitudinal axis 24, is attached to the upper end of the housing of the thread changing device. Moreover, the guide body 48 serves for slide mounting of the upper part of the slide 33. The control pins 49 are supported on one of six associated preselector levers 50 in each case, which are mounted to pivot on a further bolt and extend substantially horizontally in FIG. 4, i.e. perpendicularly to the selector levers 28. By means of springs 52 acting on their rear ends, the preselector levers 50 are biased in clockwise direction in a base position and are held in abutment with the lower ends of the associated control pins 49 projecting out of the guide body 48, the upper ends thereof projecting upwards out of the guide body 48. In addition, in their base position the preselector levers 50 abut with their front faces against locking pins 53, which are fastened to the associated selector levers 28 and project laterally away therefrom.

In the lower portion of the housing according to FIGS. 3 and 4, a number of guiding discs 54 are arranged between and parallel to the side plates 19 and 20 for lateral guidance of the thread fingers 14.

As FIGS. 1 and 2 show in particular, a selector assembly 56 is mounted on the rotatable support ring 10 that has a number of control magnets 57 corresponding to the number of thread fingers 14 and control pins 49, said control magnets being arranged offset in radial direction in keeping with the control pins 49 and spaced in peripheral direction. The control magnets 57 are each provided with a push rod 58 that can, be displaced horizontally and radially back and forth, is connected to a cam 60 by means of a lever 59 and can arrange this selectively in the range of action or outside the range of action of an associated control pin 49.

Moreover, FIG. 2 in particular shows three indexing cams 63, 64 and 65 attached to the underside of the support ring 10. In this case, the front end of the indexing cam 63 leading in the rotation or knitting direction (arrow v), but trailing behind the selector assembly 56, is associated with the selector levers 28 (FIG. 4), the subsequently leading indexing cam 64 is associated with the slide 33 and the last indexing cam 65 is likewise associated with the selector levers 28. Finally, an inserter 66 is also shown schematically in FIGS. 2 and 3, which is fastened to the support ring 10 and serves in a known manner to grasp the thread 15 fed by a selected thread finger 14 above a bar 17*a* of the thread guide 17 (FIG. 3) and securely insert it into a guide slot 17*b* of the thread guide 17 provided behind the bar 17*a*. As FIG. 1 in particular shows, the inserter 66 is fastened to an arm 67 connected to the support ring 10 and is held closely above and behind the hook of the knitting tools 2.

The remaining structure and operation of the described thread changing device are known and therefore do not require further explanation. On this basis, reference is made to documents DE 195 11 949 A1 and EP 1 612 311 B1, for example, which are herewith incorporated by reference as part of the present disclosure to avoid repetition.

In addition, the operating cycle during a thread change of the described thread changing device is indicated in FIG. 4. There a thread with reference 15*b* is shown that has just been inserted into the knitting tools 2 by the thread finger 14*b*, while thread finger 14*a*, which still holds clamped a thread 15*a* to be newly inserted, has just been directed into a working position. For this purpose the associated control magnet 57 (FIG. 1) is actuated to allow the cam 60 connected thereto to act on the respective control pin 49 and thus ensure that the thread finger 14*a* is pivoted into the working position evident from FIG. 4 by means of the cam 63 and the selector lever 28*a*.

FIG. 3 schematically shows four knitting points 68*a* to 68*d*, which are arranged one behind the other in the knitting direction v corresponding to the direction of rotation of the needle cylinder and the support ring 10 (FIG. 2) and are formed, for example, by corresponding cam segments 4*a* to 4*d* of the cam 4 (FIG. 1). Each of these cam segments 4*a* to 4*d* can move all or selected knitting tools 2 into a thread pick-up position 69 indicated only for knitting points 68*b* and 68*d*. According to FIG. 3, the thread changing devices 12 respectively have six thread fingers 14 located one behind the other in the knitting direction v.

FIG. 3 additionally shows that the width of a thread changing device 12 measured in the knitting direction v is larger than the width of the knitting points 68*a* to 68*d* or cam segments 4*a* to 4*d* measured in the same direction. Therefore, it is not possible to provide each knitting point 68*a* to 68*d* with a thread changing device 12 assigned to it alone.

For this reason, it is provided according to the invention to configure and arrange each thread changing device 12 so that threads 15 fed with it can be selectively fed to a first and/or a second knitting point. For this, a thread changing device 12 shown on the left in FIG. 3 is assigned both to a first knitting point 68*b* and a second knitting point 68*a* arranged in front of this in the knitting direction v. Accordingly, a further thread changing device 12 shown on the right in FIG. 3 is assigned to a first knitting point 68*d* and a second knitting point 68*c* arranged in front of this in the knitting direction v. In other words, in contrast to the prior art, each thread changing device 12 here is assigned to two adjacent knitting points 68*a*, 68*b* or 68*c*, 68*d*.

Figure 5:
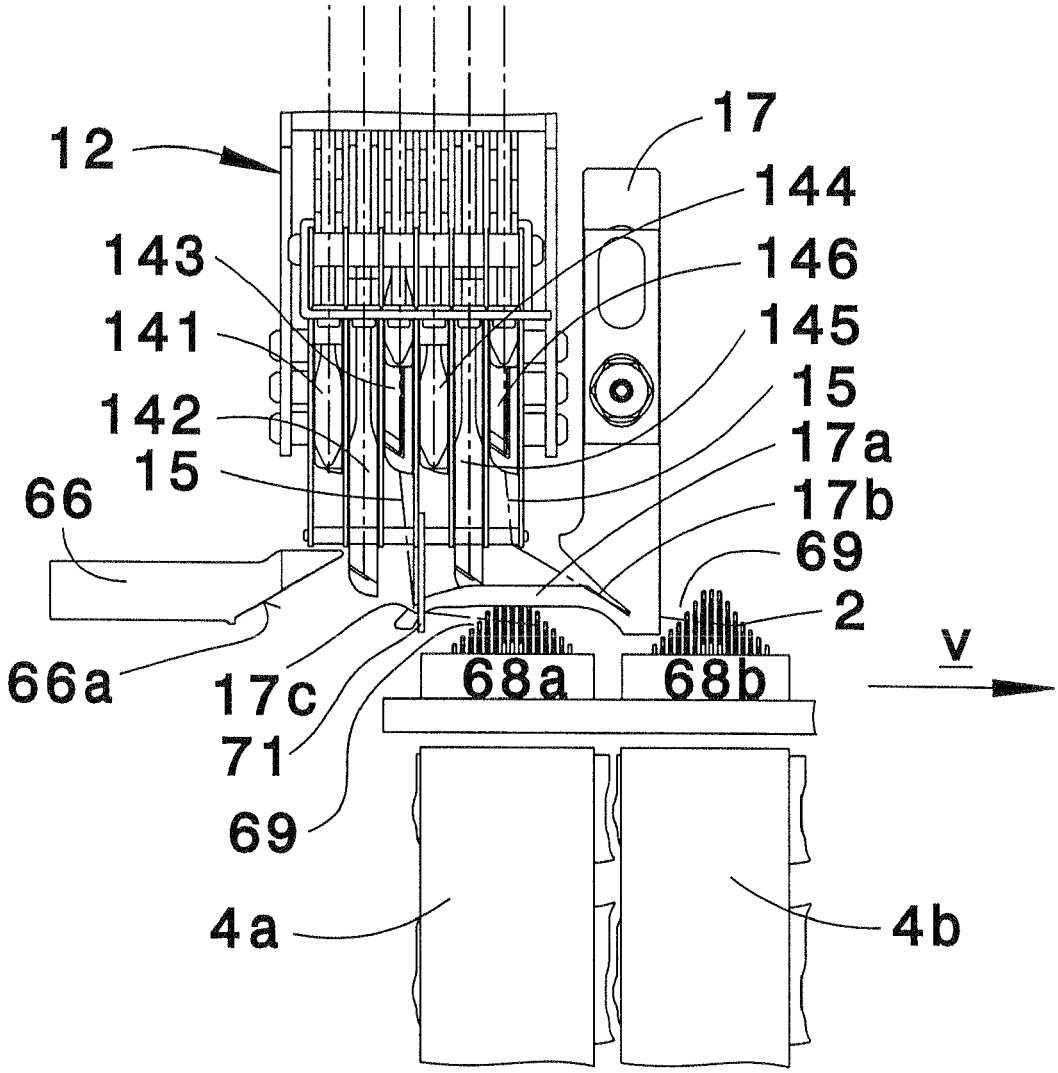
FIGS. 5 and 6 are corresponding front views of two adjacent knitting points and a thread changing device associated with these of the circular knitting machine in an operating mode changed from FIG. 3.

The advantages aimed at with the invention may be seen from a comparison of FIGS. 3 and 5.

FIG. 3 shows the production of a knitted product with a horizontal stripe pattern that is formed from a comparatively large number of different threads. For this case it is provided to use the thread changing device 12 on the left in FIG. 3 only for feeding threads 15 to the first knitting point 68*b* of the pair 68*a*, 68*b* and the thread changing device 12 shown on the right in FIG. 3 only for feeding threads 15 to the first knitting point 68*d* of the pair 68*c*, 68*d*. In contrast, the respective second knitting points 68*a* and 68*c* are switched off, i.e. are rendered inactive by appropriate selection of the cam segments 4*a* and 4*c*, such that the knitting tools 2 remain in a circular running path 70 on the knitting points 68*a* and 68*c*, i.e. are not raised into the thread pick-up position 69. As a result of this, each of the six threads 15 of the thread changing devices 12 can only be inserted into the knitting tools 2 at each second knitting point 68*b*, 68*d*. Horizontal stripe patterns with up to six different threads can be produced in this way.

In contrast, on the basis of the thread changing device 12 shown on the left of FIG. 3, FIG. 5 shows the production of a knitted product with a horizontal stripe pattern that is formed from a comparatively small number of different threads 15. For this case, it is provided in the exemplary embodiment to feed the threads 15 of the thread changing device 12 both to the first knitting point 68*b* and to the second knitting point 68*a* located in front of this of pair 68*a*, 68*b*. In particular, the arrangement is such, for example, that a group of thread fingers given the references 141, 142 and 143 here located in front in the knitting direction v feeds their threads to the knitting tools 2 raised into the thread pick-up position 69 in the second knitting point 68*a*, whereas a group of thread fingers given the references 144, 145 and 146 here located at the rear in the knitting direction v feed their threads to the knitting tools 2 moved into the thread pick-up position 69 at the first knitting point 68*b*. Therefore, in contrast to FIG. 3, the cam segment 4*a* here is provided with cam parts that can also raise the knitting tools 2 into the thread pick-up position 69. Moreover, FIG. 5 shows that the thread 15 delivered by the thread finger 143 is currently being processed at the knitting point 68*a* and the thread 15 guided by the thread finger 142 is being prepared for a thread change, while at knitting point 68*b* the thread 15 guided by the thread finger 146 is just being processed and the thread 15 guided by the thread finger 145 is being prepared for a thread change.

The arrangement in the region of the thread changing device 12 shown on the right in FIG. 3 and the associated knitting point pair 68*c*, 68*d* can be configured accordingly.

In the exemplary embodiment the thread changing devices 12 can feed a total of six threads in each case, wherein according to FIG. 5 three threads 15 are fed to the first knitting point 68*b* and the other three threads 15 are fed to the second knitting point 68*a*. However, other distributions of the thread fingers 141 to 146 over the two respective knitting points are also conceivable, as required, and each thread changing device 12 can also have more or less than six thread fingers. Moreover, it is clear that the knitting tools 2 in the case of FIG. 3 can also be raised into a thread pick-up position at the knitting point 68*a* or 68*c* in order to insert a separate foundation or plating thread or the like, for example. However, an additional thread guide would be necessary for this.

As FIGS. 3 and 5 show, a thread guide 17 is only provided at each first knitting point 68*b*, 68*d* of a pair 68*a*, 68*b* or 68*c*, 68*d* of knitting points. In this case, each bar 17*a* also extends backwards over the largest portion of the respective second knitting point 68*a*, 68*c* so that the threads 15 grasped by the inserter 66 are securely moved into the guide slot 17*b* irrespective of which thread fingers 14 feed them. On the other hand, each guide slot 17*b* is arranged so that threads 15 inserted therein are securely grasped by the knitting tools 2 raised into the thread pick-up position 69 irrespective of which thread finger 14 feeds them.

Figure 6:
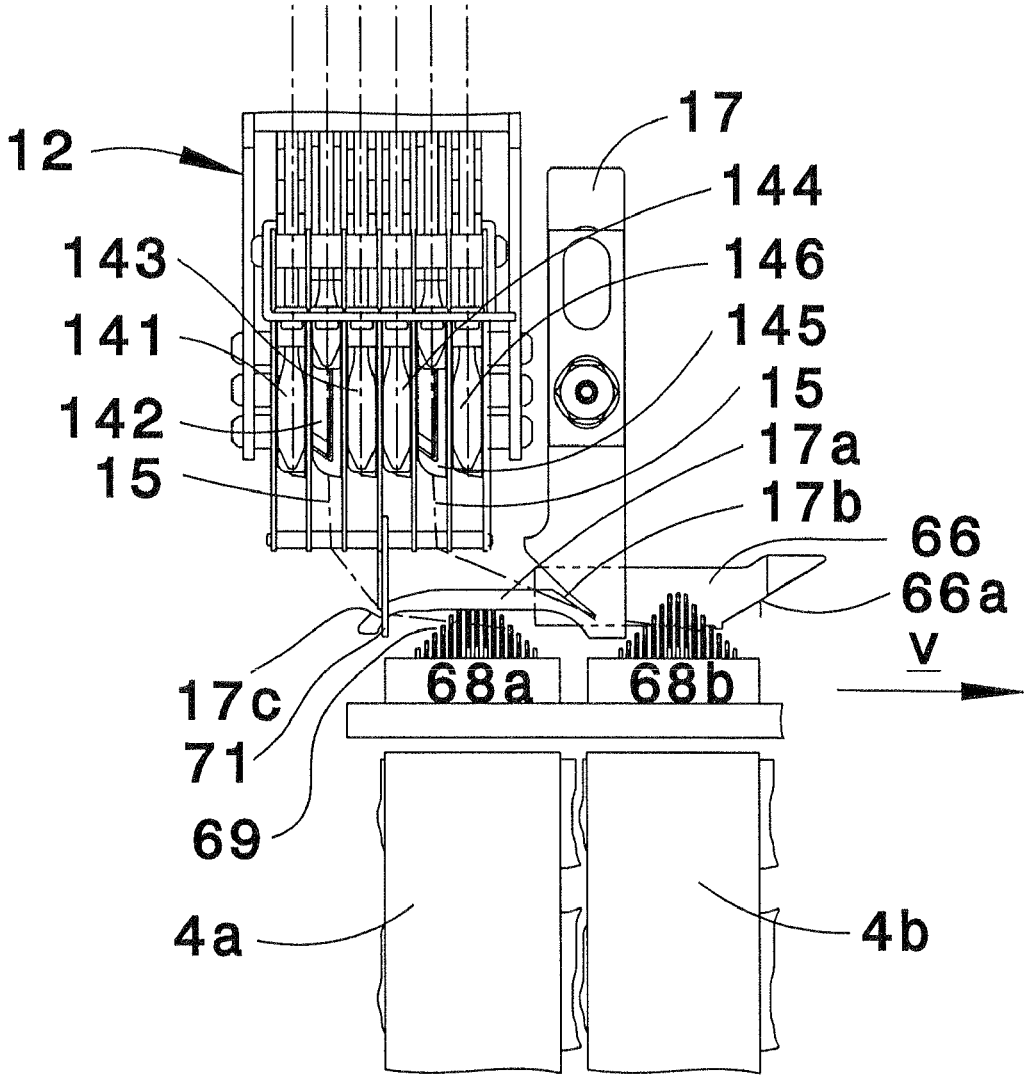

However, if according to FIGS. 5 and 6 a thread changing device 12 is used to feed two knitting points (e.g. 68*a*, 68*b*) of a pair of knitting points, then according to the invention the knitting machine preferably additionally has means that allow a secure separation of the threads fed by the two groups of thread fingers 141 to 143 or 144 to 146.

According to FIGS. 5 and 6, this means includes a thread guide 17, for example, the bar 17*a* of which not only extends to the rear over the knitting point 68*a* of pair 68*a*, 68*c* located at the front, but additionally has a second guide slot 17*c* also shown in FIG. 3. This second guide slot 17*c* occupies substantially the same position in relation to the second knitting point 68*a* as the guide slot 17 in relation to the first knitting point 68*b*. A thread 15 inserted into the guide slot 17*c* according to FIG. 5 is therefore respectively fed to the knitting tools 2 that are moved into the thread pick-up position at the second knitting point 68*a*, whereas a thread 15 inserted into the slot 17*b* according to FIGS. 3 and 5 is respectively fed to the knitting tools 2 that are moved into the thread pick-up position 69 at the first knitting point 68*b*. The procedure at the other pairs of knitting points (e.g. 68*c*, 68*d* in FIG. 3), to which one of the described thread changing devices 12 is assigned, is consistent with this. The insertion of the threads 15 fed with the thread fingers 141 to 143, for example, into the slot 17*c* can be achieved using an inserter 66, for example, which at its front end has such a sloping lower edge 66*a* (FIGS. 3 and 5) that the threads 15 guided by the first two thread fingers 141 to 143 come to lie in slot 17*c* and the threads 15 located further to the rear in the knitting direction v and guided by the thread fingers 144 to 146 come to lie in slot 17*b*.

An even better, and currently considered the best, means for separating the threads 15 is evident from FIGS. 5 and 6. Here, an additional stripper element 71 is arranged between the two groups of thread fingers 141 to 143 and 144 to 146. This stripper element 71 consists of a thin metal plate, for example, and is configured and arranged so that after they have been grasped by the lower edge 66*a* of the inserter 66, the threads 15 fed by the first group of thread fingers 141 to 143 are laid against the stripper element 71 and deflected (vertically in FIGS. 5 and 6) downwards by this and inserted into the slot 17*c*. For this, as FIGS. 5 and 6 show, a lower edge of the stripper element 71 is arranged directly behind the slot 17*c* in the knitting direction v. As a result, it is assured, on the one hand, that the threads fed by the thread fingers 141 to 143 pass into the slot 17*c* located at the front, while it is also assured, on the other hand, that the threads 15 fed by the thread fingers 144 to 146 and lying behind the stripper element 71 in the knitting direction v are inserted into the rear slot 17*b* solely by means of the inserter 66, as FIG. 6 shows. In addition, FIG. 5 shows a position of the thread fingers 142 and 145 that corresponds to the working position of the thread finger 14*a* in FIG. 4 upon preparation of a thread change, whereas FIG. 6 shows the retracted position of the thread fingers 142 and 145 resumed after passage of the inserter 66 and after the thread change.

FIGS. 7 to 11 show in a highly schematic view the insertion of a thread 15 into the guide slot 17*c* on application of the stripper element 71.

Figure 7:
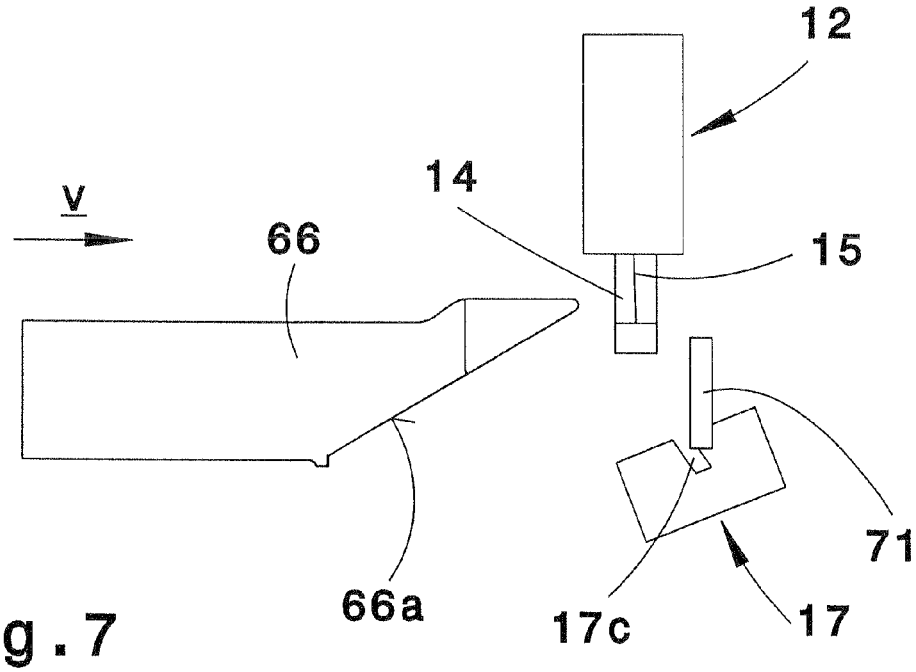
FIGS. 7 to 11 are highly schematic and enlarged views showing the mode of operation of a stripper element of the circular knitting machine according to FIGS. 5 and 6.
Figure 8:
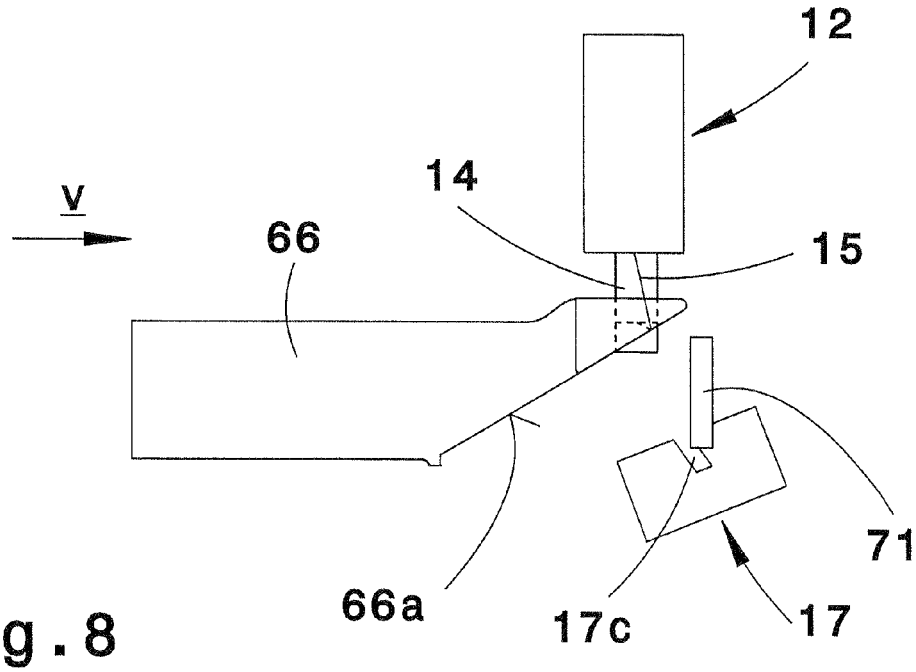

While FIG. 7 shows a thread finger 14 in the working position in accordance with FIG. 4, wherein the inserter 66 is still arranged in front of the thread finger 14, FIG. 8 shows how the thread 15 laid transversely over the circle of knitting tools 2 by the thread finger 14 is just being grasped by the lower edge 66*a* of the inserter 66 moved in the knitting direction v.

Figure 9:
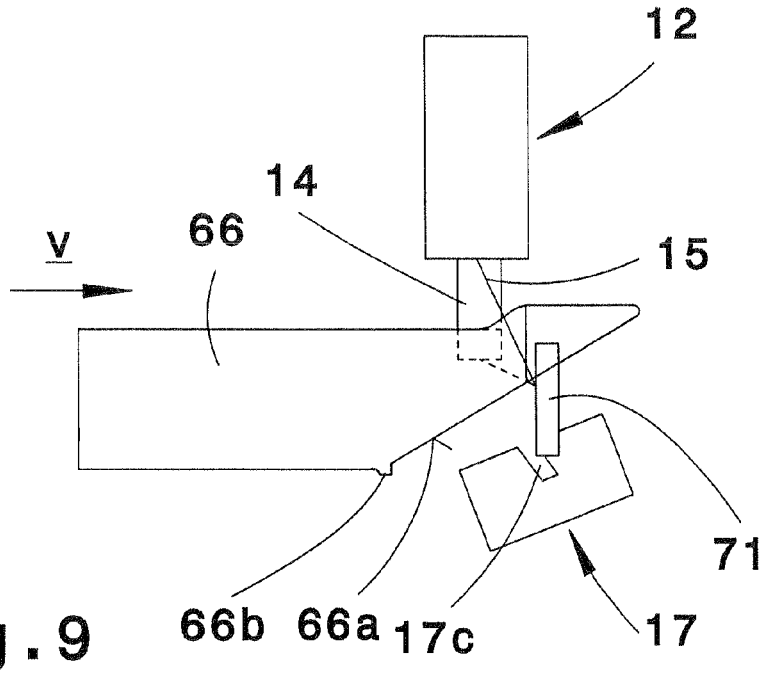
Figure 10:
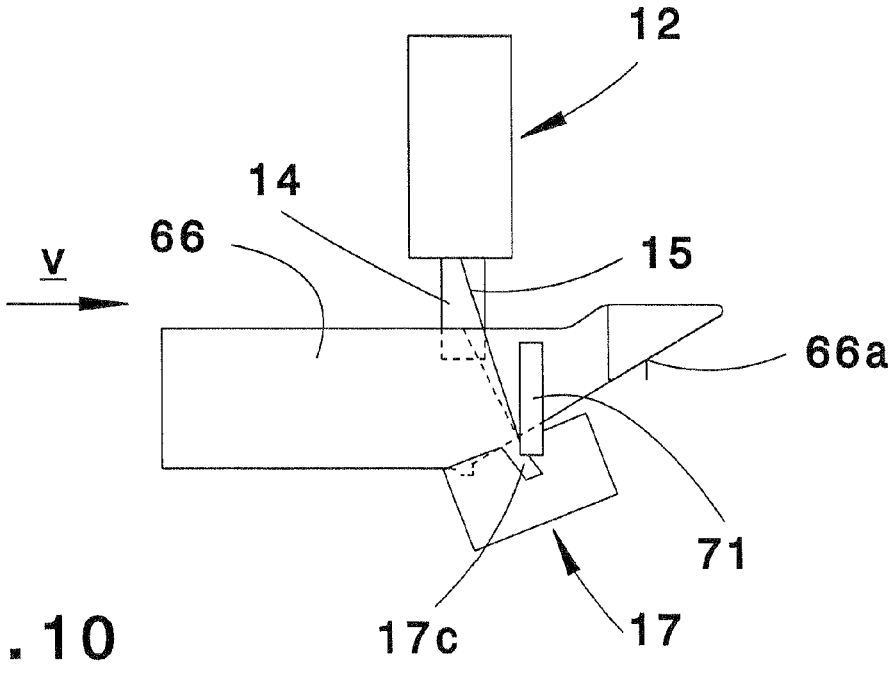
Figure 11:
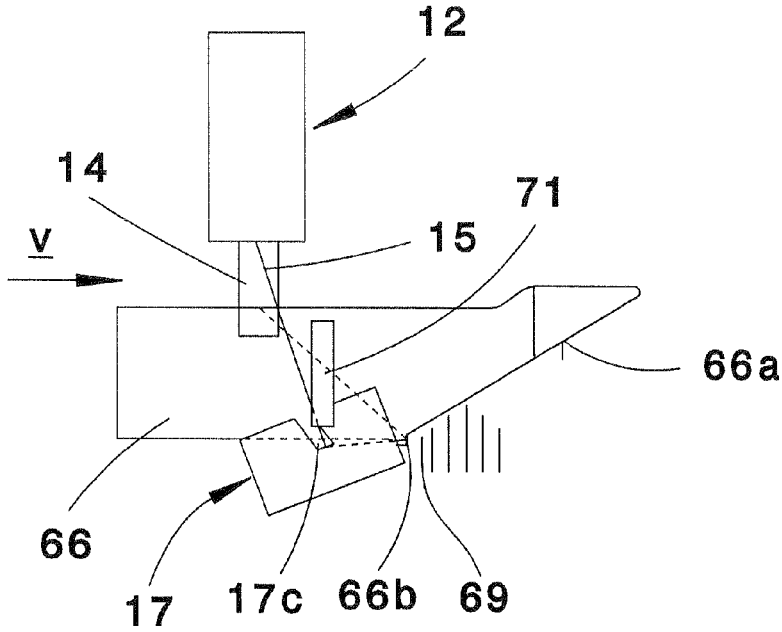

FIG. 9 shows that as the inserter 66 moves on, the thread 15 is pressed downwards in the knitting direction v by the lower edge 66*a* thereof, but abuts against the stripper element 71, as a result of which its movement in the knitting direction v is blocked. Therefore, as shown in FIG. 10, the thread 15 shifts further downwards only along a front edge of the stripper element 71 until it finally lands securely in the guide slot 17*c*, as shown in FIG. 11. In this case, in FIGS. 9 to 11 a respective portion of the thread 15 located in front of the inserter 66 is illustrated by a solid line and a respective portion of the thread 15 located behind the inserter 66, with its end still clamped in the thread finger 14, is illustrated by a broken line.

In addition, a provision according to a further preferred exemplary embodiment of the invention can be to provide the inserter 66 according to FIGS. 7 to 11 with a hook 66*b* configured on its lower edge. This hook 66*b* is configured and arranged such that it grasps the thread 15 inserted into the guide slot 17*c* and entrains it as far as the knitting tools 2 raised into the thread pick-up position 69, as indicated schematically by the broken line in FIG. 11. The hook 66*b* in the region of the guide slot 17*b* (not shown in FIGS. 7 to 11) can have the same effect. It is thus possible to also insert the threads 15 securely into the knitting tools 2 when the paths, along which the knitting tools 2 are raised into the thread pick-up position 69, do not lie directly next to the guide slots 17*c*, 17*b*.

Figure 12:
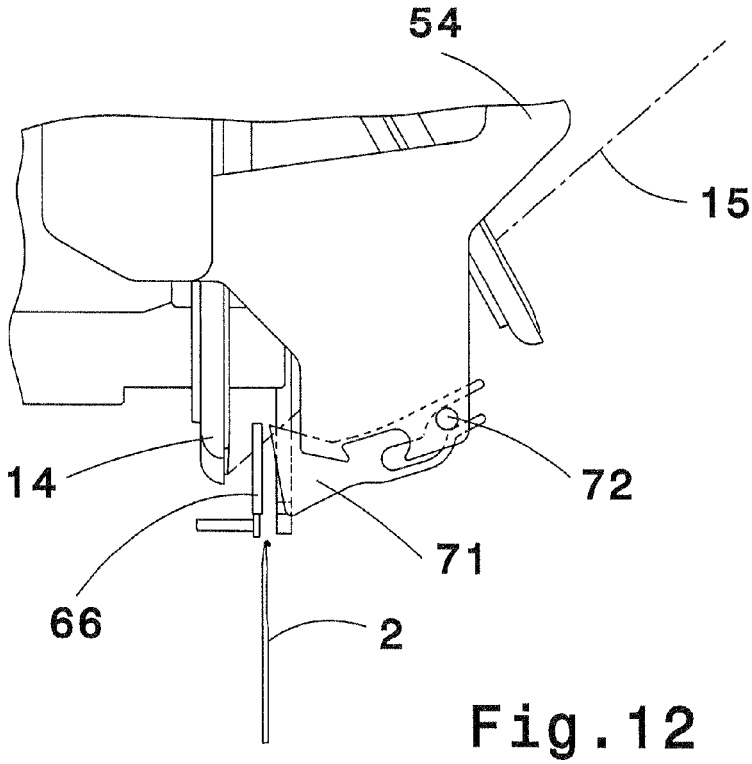
FIG. 12 shows a possibility of detachably fastening the stripper element according to FIGS. 7 to 11 to the thread changing device according to FIGS. 5 and 6.

The means for securely separating the threads 15, which are fed by the two groups 141 to 143 or 144 to 146 of thread fingers 14, are preferably configured so that the knitting machine can be easily converted from the operating mode according to FIG. 3 to the operating mode according to FIGS. 5 and 6 or vice versa. For this, the stripper element 71 is mounted in an easily replaced manner in the thread changing device 12 or another component of the knitting machine. It would be possible, for example, to attach a bolt 72 (FIG. 12) to a guide disc 54 arranged between the two thread fingers 143 and 144, onto which bolt the stripper element 71 can be placed and then secured possibly by press fit or with a screw (not shown). When the stripper element 71 is attached, there then results the function according to FIGS. 5 and 6, while when the stripper element 71 is detached, the function according to FIG. 3 is obtained. Alternatively, in the case where insertion of the threads 15 into the guide slot 17*c* only occurs by means of the inserter 66, for example, it would also be possible to provide a covering cap for the guide slot 17*c*. When this covering cap is attached, the threads 15 fed by the first thread fingers 141 to 143 would then also automatically slide beyond the guide slot 17*c* along the bar 17*a* (FIG. 3) and into the guide slot 17*b*. Moreover, the front guide slot 17*c* could be configured on a separated detachable component, which is fixedly connected to the bar 17*a* of the thread guide 17 in the case of the operating mode of FIGS. 5 and 6 and is separated from this in the case of the operating mode of FIG. 3.

The invention is not restricted to the described exemplary embodiment, which can be modified in a variety of ways. In particular, the invention is not restricted to only two knitting points 68 assigned to the thread changing devices 12. Rather, it would also be possible to assign particularly wide thread changing devices 12 provided with more than six thread fingers to three or more knitting points 68, in which case a further stripper element 71 and a further guide slot would have to be provided in the bar 17*a* of the thread guide 17. In this way, for example, in the illustrated exemplary embodiment the threads of the two thread changing devices 12 could be assigned to three respective knitting points 68 arranged one behind the other in the knitting direction v. Moreover, it is clear that the circular knitting machine according to FIG. 1 only represents an example and with corresponding modification the invention can also be achieved on other knitting machines. Moreover, other means, in particular other inserters and stripper elements, can also be provided in order to assure a secure distribution of the different threads 15 over the knitting points 68 present in an individual case. Moreover, other guide elements such as e.g. grooves, edges or the like can also be provided on the thread guide 17 instead of the guide slots 17*b* and 17*c*. Besides this, due to the widths thereof as many knitting points 68 as possible can be provided on the periphery of a circular knitting machine, for example, while the thread changing devices 12 are respectively assigned to two or more knitting points in dependence on their width. However, only a few knitting points with associated thread changing devices can also be provided, as required. In principle, a knitting machine, in particular a small circular knitting machine, that has only one thread changing device 12 and two or more associated knitting points 68 is also conceivable. Finally, it is understood that the different features can also be applied in other combinations then those described and illustrated.

It will be understood that each of the elements described above, or two or more together, may also find a useful application in other types of methods and constructions differing from the types described above.

While the invention has been illustrated and described as embodied in a method and knitting machine for the production of knitted goods with horizontal stripe patterns, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for production of knitted goods with horizontal stripe patterns on a knitting machine containing knitting tools, at least one first knitting point, a second knitting point arranged in front of the first knitting point in a knitting direction, and also at least one thread changing device, the method comprising the steps of bringing at least some of the knitting tools at at least one knitting point into a thread pick-up position; by the thread changing device, fitting at least one selected thread to the knitting tools brought into the thread pick-up position; associating the thread changing device with the first and the second knitting points; and selectively feeding by the thread changing device at least one selected thread in each case to the knitting tools brought into the thread pick-up position at a knitting point selected from the group consisting of at the first knitting point, at the second knitting point, and at both knitting points.

2. A method as defined in claim 1, further comprising providing the thread changing device with a multiplicity of the thread fingers arranged one behind the other in the knitting direction; using a group of the thread fingers located at front in the knitting direction for feeding threads to the knitting tools moved into the thread pick-up position at the second knitting point; and using a group of the thread fingers located behind in the knitting direction for feeding threads to the knitting tools brought into the thread pick-up position at the first knitting point.

3. A knitting machine for production of knitted goods with horizontal stripe patterns, comprising at least one support provided with movable knitting tools; a cam with at least one first knitting point and a second knitting point arranged in front in a knitting direction for moving selected knitting tools into a thread pick-up position; at least one thread changing device feeding selected threads to the knitting tools brought into the thread pick-up position at the first knitting point and configured and arranged in such a manner that the threads which are fed with it are selectively fed to the knitting tools moved into the thread pick-up position at a knitting point selected from the group consisting of the first knitting point, the second knitting point, and both; and means for securely separating the threads fed by two groups of thread fingers, wherein the means include a thread guide with two guide elements located one behind the other in the knitting direction and each associated with one of the two knitting points and an inserter which inserts the thread fed by the first group of thread fingers into a guide element located at front in the knitting direction and inserts the threads fed by the second group of thread fingers into the guide element located at rear in the knitting direction, wherein the means also include a stripper element cooperating with the inserter arranged between the two groups of thread, and wherein the stripper element is detachably mounted and when the stripper element is detached the inserter inserts threads which are fed with both groups of the thread fingers into the guide element located at rear in the knitting direction.

4. A knitting machine as defined in claim 3, wherein the thread changing device includes a multiplicity of thread fingers arranged one behind the other in the knitting direction, and having a first group of thread fingers located at front in a knitting direction and used for feeding threads to the knitting tools brought into the thread pick-up position at the second knitting point, and a second group of thread fingers located behind the first group in the knitting direction and used for feeding threads to the knitting tools brought into the thread pick-up position at the first knitting point.

5. A knitting machine as defined in claim 3, wherein the thread changing device is arranged so that threads which are fed with it, are also selectively fed only to the knitting tools moved into the thread pick-up position at the first knitting point.

6. A knitting machine as defined in claim 5, wherein the second knitting point is switchable if threads which are fed with the thread changing device are only fed to the knitting tools brought into the thread pick-up position at the first knitting point.

7. A knitting machine as defined in claim 3, wherein the guide element located at front in the knitting direction is covered.

8. A knitting machine as defined in claim 7, wherein the guide element located at front in the knitting direction is fastened to a structural part detachably connected to the thread guide.

* * * * *